US009562742B2

(12) United States Patent
Popovici

(10) Patent No.: US 9,562,742 B2
(45) Date of Patent: Feb. 7, 2017

(54) FOOT ORTHOSIS AND EXOSKELETON

(71) Applicant: Bryan Popovici, Liverpool, NY (US)

(72) Inventor: Bryan Popovici, Liverpool, NY (US)

( * ) Notice: Subject to any disclaimer, the term of this patent is extended or adjusted under 35 U.S.C. 154(b) by 0 days.

(21) Appl. No.: 14/818,822

(22) Filed: Aug. 5, 2015

(65) Prior Publication Data

US 2015/0338189 A1 Nov. 26, 2015

Related U.S. Application Data

(63) Continuation-in-part of application No. 13/173,498, filed on Jun. 30, 2011, now Pat. No. 9,121,673.

(51) Int. Cl.
*F41C 33/02* (2006.01)
*F41H 1/02* (2006.01)

(52) U.S. Cl.
CPC ..... *F41C 33/0209* (2013.01); *F41C 33/0236* (2013.01); *F41H 1/02* (2013.01)

(58) Field of Classification Search
CPC . F41C 33/046; F41C 33/0209; F41C 33/0236; A45F 2005/008; A45F 2005/0591; A45F 5/00; F41H 1/02
USPC ..... 224/222; 36/136; 602/27
See application file for complete search history.

(56) References Cited

U.S. PATENT DOCUMENTS

| | | | | |
|---|---|---|---|---|
| 2,949,111 | A | 8/1960 | Ruotoistenmaki | |
| 3,086,521 | A | 4/1963 | Desai et al. | |
| 3,805,773 | A | 4/1974 | Sichau | |
| 4,029,242 | A | 6/1977 | Stoesser | |
| 4,410,118 | A | 10/1983 | Taurisano | |
| 5,727,341 | A | 3/1998 | Saylor | |
| 5,934,531 | A | 8/1999 | Jablonic et al. | |
| 6,110,130 | A * | 8/2000 | Kramer | A61B 5/1071 600/587 |
| 6,176,402 | B1 | 1/2001 | Rogers | |
| 7,766,851 | B2 | 8/2010 | Lindh et al. | |
| 7,954,777 | B2 * | 6/2011 | Bohm | F16M 11/10 248/274.1 |
| 8,323,224 | B2 | 12/2012 | Shlomovitz | |
| 2005/0198872 | A1 | 9/2005 | Correa | |
| 2013/0228601 | A1 | 9/2013 | Velarde | |
| 2013/0231598 | A1 | 9/2013 | Velarde et al. | |

(Continued)

OTHER PUBLICATIONS

Corey Nelson Skurdal, USPTO Office Action, U.S. Appl. No. 13/173,498, Notification Date Nov. 12, 2013, 13 pages.

(Continued)

*Primary Examiner* — Corey Skurdal
(74) *Attorney, Agent, or Firm* — Maxine L. Barasch; Keohane & D'Alessandro PLLC

(57) ABSTRACT

The present invention contemplates a variety of apparatuses for carrying and concealing a weapon holster on a lower leg. A device is provided that offloads weight associated with a leg-carried weapon and eliminates torque forces caused by walking with said weapon. Supplies or alternative weapons can also be carried. The device includes an anterior exoskeleton bracket and, in some embodiments, a foot orthosis. A holster is mounted near the top of the device. The exoskeleton, attaching to the foot orthosis or a shoe/boot, provides ankle support and offloads the weight of the weapon. A variable resistance linkage is integrated into the exoskeleton. The resistance is adjustable for a particular user based on physical condition.

20 Claims, 15 Drawing Sheets

(56) References Cited

U.S. PATENT DOCUMENTS

2015/0057587 A1* 2/2015 Walsh ..... A63B 59/70
602/16

OTHER PUBLICATIONS

Corey Nelson Skurdal, USPTO Final Office Action, U.S. Appl. No. 13/173,498, Notification Date Apr. 16, 2014, 9 pages.
Corey Nelson Skurdal, USPTO Office Action, U.S. Appl. No. 13/173,498, Notification Date Sep. 2, 2014, 10 pages.
Corey Nelson Skurdal, USPTO Notice of Allowance and Fee(s) Due, U.S. Appl. No. 13/173,498, Date Mailed Apr. 23, 2015, 8 pages.
"Universal Joint", Wikipedia, Wayback Machine, https://web.archive.org/web/20100309223002/http://en.wikipedia.org/wiki/Universal_joint, Mar. 9, 2010, 5 pages.

* cited by examiner

Figure 3A
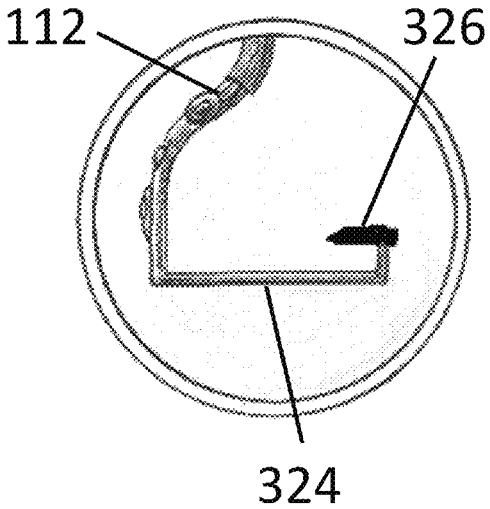
Figure 3C
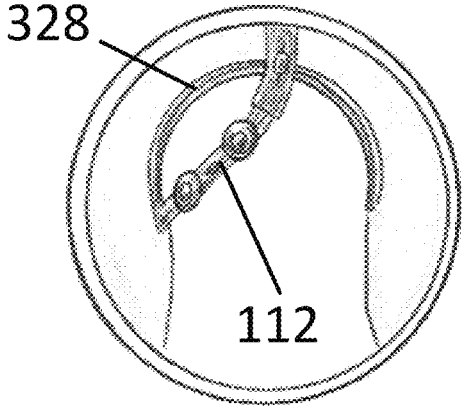
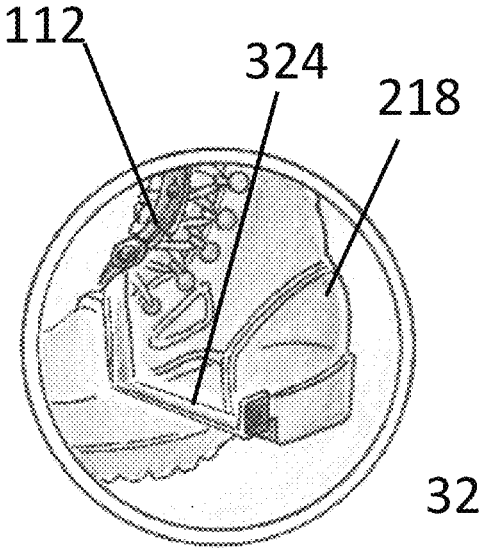
Figure 3B
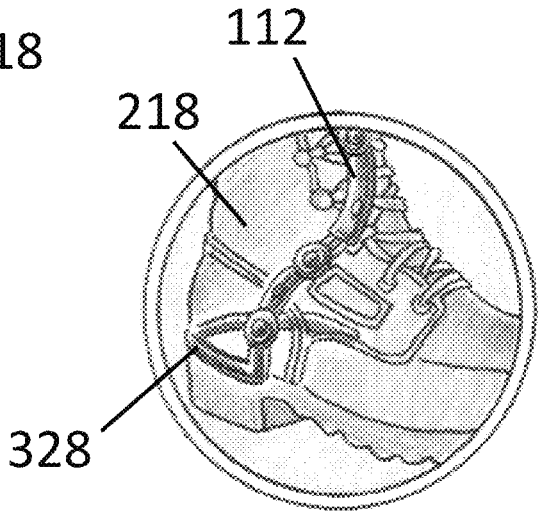
Figure 3D

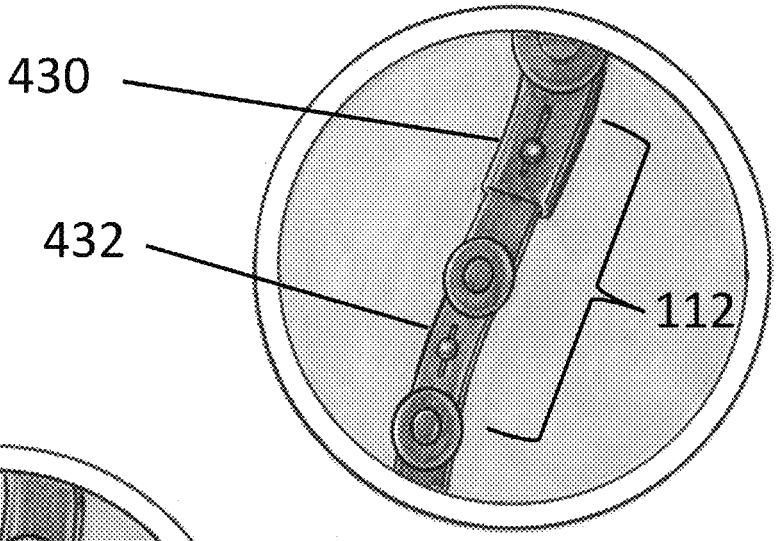
Figure 4A
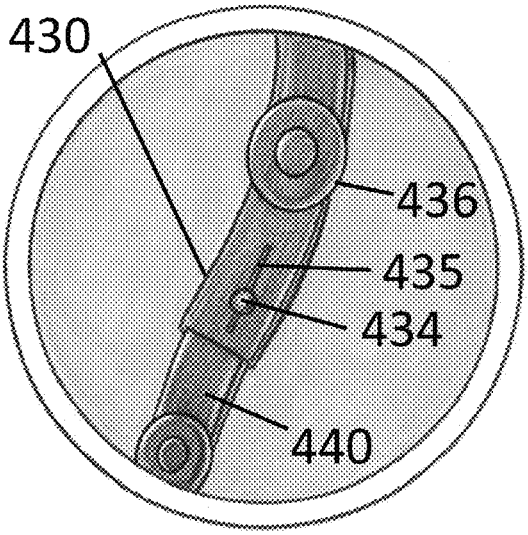
Figure 4B
Figure 4C
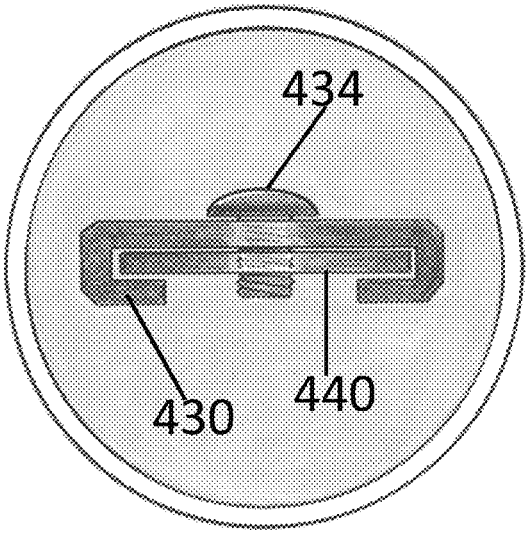

FOOT ORTHOSIS AND EXOSKELETON

The present patent document is a continuation-in-part of commonly-owned and co-pending application Ser. No. 13/173,498 filed Jun. 30, 2011, the disclosure of which is incorporated herein by reference.

FIELD OF THE INVENTION

The present invention relates generally to a weapon holster and more specifically to a device for wearing a weapon holster on the lower leg.

BACKGROUND OF THE INVENTION

The ability to carry and conceal a weapon provides challenges for the carrier. Not only does the weapon need to be easily accessed with each attempt to remove the weapon for use, moreover all day wear with comfort should be expected. Ankle holsters are one device used to perform this task. The torque forces applied at the ankle and lower leg through the normal phases of walking twist a holstered weapon itself upon the lower extremity. Even the lightest of weapons used with an ankle holster produce a significant torque. Essentially, the weapon decelerates and accelerates slower than the swing or contact phase of the foot. Rapid deceleration/acceleration involved in the normal process of walking produces rotation of the weapon around contact points on a user's leg. Add the act of running, or other strenuous activity, and the above situation is drastically accentuated. Some ankle holsters employ a tight ankle cuff in order to reduce rotational forces on the carried weapon. A tight cuff on the lower leg can adversely affect blood circulation, as well as produce a source of discomfort and interfere with physical activities. An ankle holster is sometimes worn over a high ankle boot, but even this can cause discomfort and awkwardness when walking. The location of the ankle holster components on the leg can also contribute to the ability of a carrier to successfully conceal a weapon.

SUMMARY OF THE INVENTION

The present invention contemplates a variety of apparatuses for carrying and concealing a weapon holster on a lower leg. A device is provided that offloads weight associated with a leg-carried weapon and eliminates torque forces caused by walking with said weapon. Supplies or alternative weapons can also be carried. The device includes an anterior exoskeleton bracket and, in some embodiments, a foot orthosis. A holster is mounted near the top of the device. The exoskeleton, attaching to the foot orthosis or a shoe/boot, provides ankle support and offloads the weight of the weapon. In embodiments, the exoskeleton has a two hinge system for flexibility and adjustability. In other embodiments, in place of (or in addition to) the two hinge system, the exoskeleton includes a variable resistance linkage that provides resistance and/or establishes range-of-motion limits to accommodate individual users. The resistance and/or range-of motion limits can be tailored to an individual based on strength, injuries, and/or other physiological and environmental factors. Additionally, the exoskeleton attaches to the shoe/boot by one of several embodiments, including a simple L-bracket, a U-bracket wrapping around the heel, and a clip-on bracket wrapping under the sole. The orthosis is customized to a carrier's foot, providing comfort and offsetting the weight of the weapon.

A first aspect of the present invention provides a device, comprising: a foot orthosis comprising a first edge and a second edge such that, when the device is donned by a wearer, the first edge is oriented along an outside edge of a foot of the wearer and the second edge is oriented along an inside edge of the foot of the wearer; a brace configured such that when the device is donned by a wearer, a position of a vertical center axis of the brace substantially aligns with a position of a vertical center axis of a shin of the wearer; an essentially vertical anterior exoskeleton comprising an elongated member disposed along the vertical center axis of the brace and extending from the brace to the first edge of the foot orthosis; and a variable resistance linkage disposed along the exoskeleton, the variable resistance linkage configured such that, when the device is donned by the wearer, at least a portion of the exoskeleton is allowed to move with the foot of the wearer at least in a frontal plane and a sagittal plane.

A second aspect of the present invention provides a device, comprising: a holster support comprising: an exoskeleton, a brace connected at essentially a top end of the exoskeleton, an item of footwear attaching to a bottom end of the exoskeleton, and a variable resistance linkage disposed along the exoskeleton, the variable resistance linkage comprising two variable resistance joints; and a holster connected to the brace of the holster support; wherein the item of footwear comprises a first edge and a second edge such that, when the device is donned by a wearer, the first edge is oriented along an outside edge of a foot of the wearer and the second edge is oriented along an inside edge of the foot of the wearer; wherein the brace is configured such that when the device is donned by a wearer, a position of a vertical center axis of the brace substantially aligns with a position of a vertical center axis of a shin of the wearer; wherein the variable resistance linkage is configured such that, when the device is donned by the wearer, at least a portion of the exoskeleton is allowed to move with the foot of the wearer at least in a frontal plane and a sagittal plane; and wherein the exoskeleton comprises an elongated member disposed essentially along the vertical center axis of the brace and extending from the brace to the first edge of the item of footwear.

A third aspect of the present invention provides a variable resistance linkage disposed on a holster support device comprising, the variable resistance linkage comprising: a plurality of variable resistance joints, wherein each variable resistance joint comprises: a first elongated member; a first fork disposed on a distal end of the first elongated member; a second elongated member; a second fork disposed on a distal end of the second elongated member; a central hub rotatably secured to the first fork and the second fork by a plurality of axles; and a plurality of resistance members configured to apply an adjustable amount of resistance to the plurality of axles.

BRIEF DESCRIPTION OF DRAWINGS

These and other objects, features, and characteristics of the present invention will become more apparent to those skilled in the art from a study of the following detailed description in conjunction with the appended claims and drawings, all of which form a part of this specification. In the drawings:

FIGS. 3A and 3B depict an ankle holster device with a clip-on bracket according to an embodiment of the present invention.

FIGS. 3C and 3D depict an ankle holster device with a U-shaped heel bracket according to an embodiment of the present invention.

FIG. 4A depicts a section of ankle holster exoskeleton according to an embodiment of the present invention.

FIG. 4B depicts a magnified section of ankle holster exoskeleton according to an embodiment of the present invention.

FIG. 4C depicts a cross-section of ankle holster exoskeleton according to an embodiment of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. When used, like numbering represents like elements.

DETAILED DESCRIPTION OF THE INVENTION

Embodiments of the present invention provide a device with a variable resistance exoskeleton, and can include a comfortable ankle holster which offloads the weight of a carried weapon, thereby addressing several problems with earlier ankle holsters. Existing ankle holsters fail to aid in offloading carried weight while eliminating forces of torque applied by a carried item. The ankle holster support of embodiments of the present invention, however, bypasses earlier problems of torque, weight, and comfort, thereby allowing the carrying of a concealed weapon with ease. Furthermore, supplementary supplies (e.g., magazines) or alternative weapons (e.g., a knife, taser, pepper spray) can be easily attached to the holster without the additional fatigue or discomfort if user so desires.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. It will be further understood that the terms "comprises" and/or "comprising", or "includes" and/or "including", when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
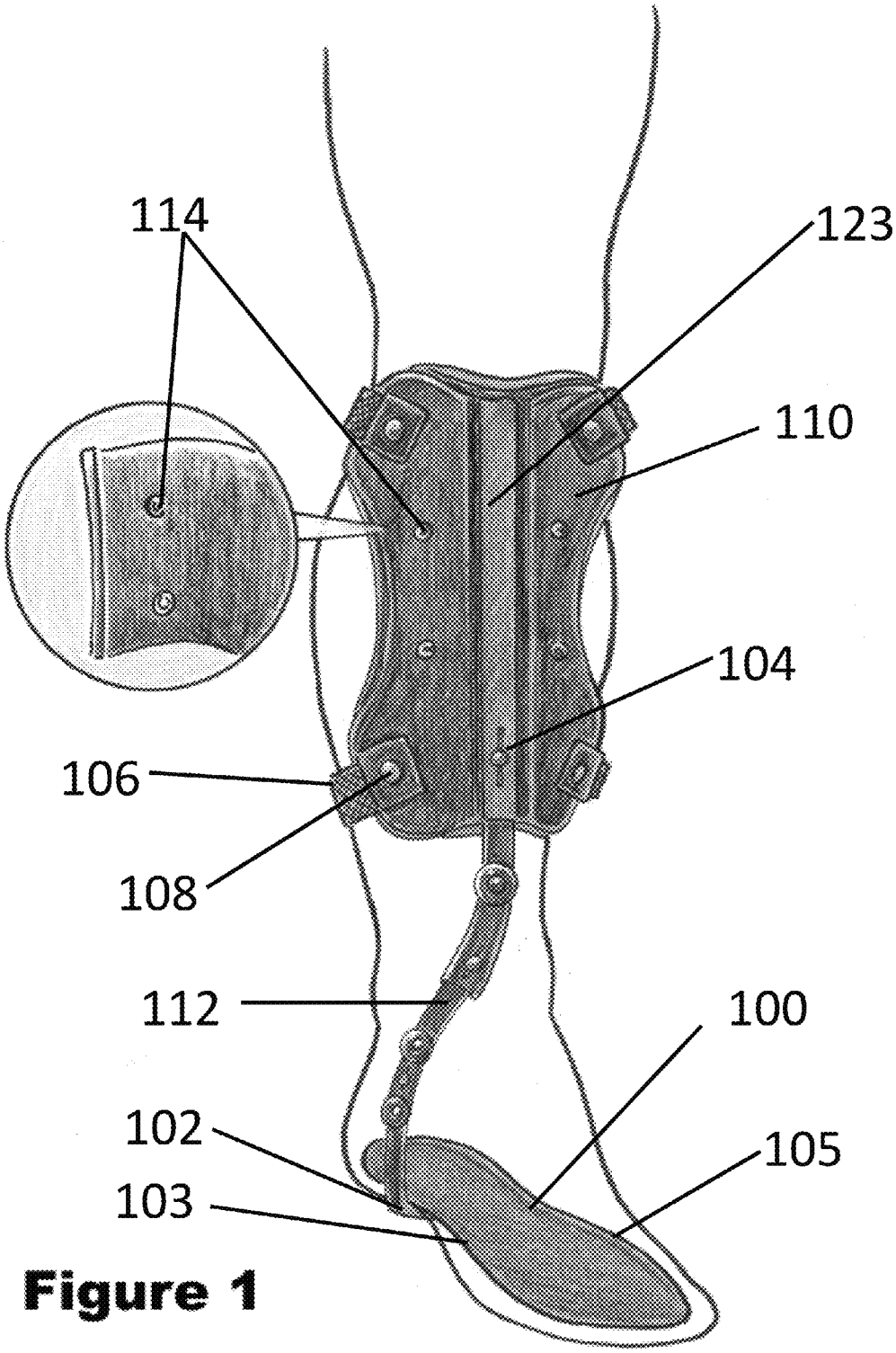
FIG. 1 depicts a foot orthosis with an exoskeleton according to an embodiment of the present invention.

Referring now to FIG. 1, foot orthosis 100 with exoskeleton 112 according to an embodiment of the present invention is depicted. Foot orthosis 100 and exoskeleton 112 (preferably made of polycarbonate or another sturdy material) provide the basis for one embodiment of the ankle holster support device. The foot orthosis 100 comprises a first edge 103 and a second edge 105 such that, when the device is donned by a wearer, the first edge is oriented along an outside edge of a foot of the wearer and the second edge is oriented along an inside edge of the foot of the wearer. Exoskeleton 112, a rod or bracket like support, attaches to foot orthosis 100 at attachment site 102. At attachment site 102, a load supported by exoskeleton 112 is transferred to foot orthosis 100 and distributed throughout the orthosis. Exoskeleton 112 is depicted in FIG. 1 as running along an anterior section of a lower leg starting near the knee and then bending to a lateral section of the leg as exoskeleton 112 reaches the foot. However, the placement of exoskeleton 112 against a side of a leg can vary. Brace 110 is attached to exoskeleton 112 with connector 104 near the top of exoskeleton 112. Brace 110 generally has a large surface area for supporting and distributing the weight of a weapon. Brace 110 can be held in place by straps 106 and snaps 108 or other methods of attachment. Holster connectors 114 (e.g., snaps, Velcro) allow a weapon to be attached and removed from the ankle holster support. When donned by a wearer, a position of a vertical center axis 123 of the brace 110 substantially aligns with a position of a vertical center axis of a shin of the wearer.

Even with the lighter guns available, traditional ankle holsters produce torque, or a rotational force, on the lower extremity of a leg when a wearer is walking. Due to this lack of motion control, traditional ankle holsters make running near impossible. However, the ankle holster of embodiments of the present invention eliminates torque forces by restricting twisting action at multiple points of contact. The strongest set of contact points are produced by foot orthosis 100, which sits atop the sole of a shoe, making contact with the sides of said shoe. The sides of the shoe to foot orthosis 100 contact restrict torque movement. Additionally, exoskeleton 112 resists torque due to its rigid nature and broad contact site with the anterior aspect of the leg.

Additionally, foot orthosis 100, acting as the bottom of the ankle holster support, bears the load of a weapon or additional supplies during heel and foot strikes. This allows the carrier of a weapon to be temporarily relieved of its weight during the carrier's gait cycle, improving the performance of the carrier's movement. Weight and fatigue issues are eliminated when a foot is on the ground due to foot orthosis 100 sitting below the user's foot. Situations, especially those requiring rapid movement, such as tactical situations which involve running, will benefit from this device.

Foot orthosis 100 will provide a wearer with options, including a customized foot orthosis. A customized foot orthosis is manufactured via incorporation of a negative cast of the wearer's foot, which is then used to make the wearer's foot orthotic. Several methods may be employed in the casting or model production of the wearer's foot. For example, the wearer can press his/her foot into a set of foam blocks to produce a negative cast of the foot. Also, a casting can be made from a standard plaster mold taken at the wearer's local podiatrist/orthotist or orthopedic doctor's office. From a negative cast, a positive cast is produced, allowing the materials of the foot orthosis to be applied to the model. This allows foot orthosis 100 to essentially copy the exact curvature of the bottom of the wearer's foot. Additionally, in lieu of creating a negative cast followed by a positive cast, an electronic scanning device can be employed to create a digital representation of a wearer's foot, to which specifications for a foot orthosis may be digitally created and subsequently manufactured. It is understood that varying materials and their applications would require changes in manufacturing. Multiple manufacturing processes are applicable to the foot orthosis device, ranging from CNC (computer numerical control) machining to injection molding techniques. The end result will produce a foot orthosis device controlling action to a wearer's foot, thereby minimizing fatigue with daily use. Furthermore, minimizing pronatory issues in a wearer's foot will prove itself very helpful. It should be further noted that off-the-shelf or prefabricated foot orthosis devices are also an option available to a wearer. Such a prefabricated foot orthosis can be sized, for example, according to traditional foot dimensions (e.g., shoe size, width, and length). While such an orthosis would not offer the same degree of comfort as a custom made foot orthosis, a prefabricated foot orthosis, made to the correct generic size of a wearer's foot, still offers comfort, offsets the weight of a carried holstered item, and provides a countermeasure against torque forces.

Extended periods of standing and/or walking expected in security and military work stress the lower extremity. Therefore, any minimizing of such stress/fatigue will increase performance when it is most needed. The custom foot orthosis aspect of the ankle holster support device described in the above paragraph provides such a measure. Government or military applications of the present invention are apparent, particularly in situations with extended marches. For example, issue to special operations forces would provide a measure of increased comfort and walking ability, thereby enhancing performance of the team. The holster's placement on the leg further enhances efficiency by freeing up hands to attend to defense or attack issues. The sole of foot orthosis 100, where the orthosis connects to exoskeleton 112 (the bottom of which can take the shape of the sole) can be enhanced with Kevlar or other similar materials for direct ballistic protection of the bottom of the wearer's foot (Kevlar is a registered trademark of E. I. du Pont de Nemours and Company). This measure will help decrease or eliminate the extent of damage and disability by sharp and projectile objects incorporated into antipersonnel weaponry in the event of incident.

Figure 2:
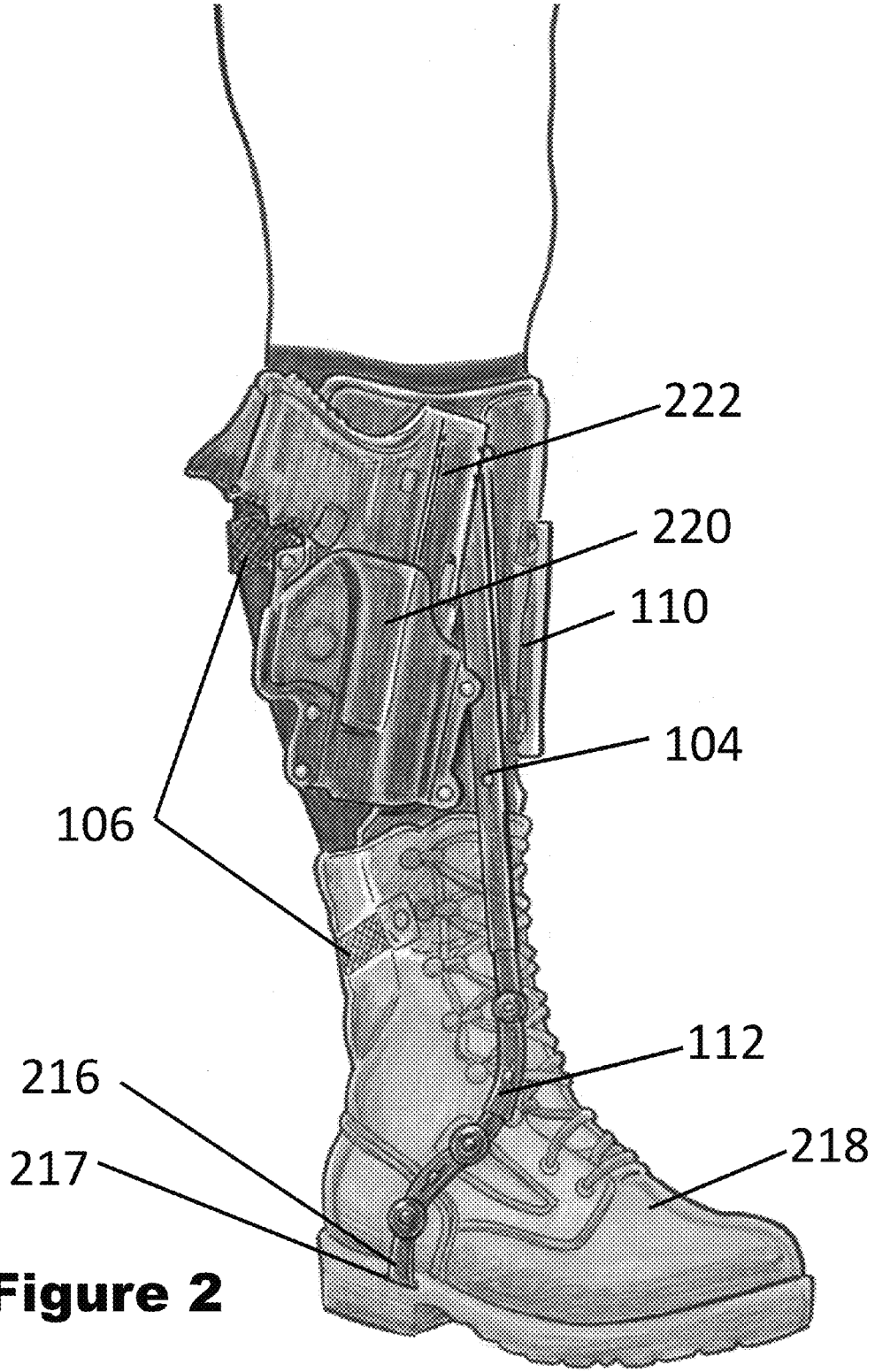
FIG. 2 depicts an ankle holster device with a simple L-bracket according to an embodiment of the present invention.

Referring now to FIG. 2, an ankle holster device with simple L-bracket 216 slipped into slot 217 on the heel of boot 218 according to an embodiment of the present invention is depicted. In addition to being supported by foot orthosis 100 (FIG. 1), in some embodiments exoskeleton 112 instead is attached to and channels holster 220 and weapon 222 weight into an item of footwear, such as a boot or shoe. Whereas orthosis 100 allowed total concealment of the ankle holster support device, an exoskeleton attached directly to a boot/shoe generally leaves a portion of exoskeleton 112 exposed. Therefore, this simplified exoskeleton rod to shoe/boot attachment should be used when concealment is not paramount, but a simplified device is desired. In the embodiment depicted in FIG. 2, bracket 216 is disposed at the bottom end of exoskeleton 112 and has an "L" shaped end. This "L" ending is slipped into slot 217 on the heel of boot 218. Preferably, special "duty shoes," with slot 217 are produced to be used in conjunction with the ankle holster. However, methods exist to add slots to existing shoes if necessary to accommodate bracket 216. It should also be noted that the place of attachment to the shoe can vary from medial to lateral depending on user preference for all variations of exoskeleton 112 attachments.

The simplified exoskeleton 112 rod to shoe/boot 218 attachment is effective as pertains to resisting shear and rotational forces and assisting in offloading weight as weapon 222 is carried through the gait cycle. Heel contact begins the walking or running cycle of a person's stride, and requires a significant deceleration. The weight of a weapon adds to the strain required to provide such deceleration. However, with the ankle holster to boot support part of the entire shoe/foot unit, a wearer goes through considerably less fatigue. The rigidity of the frame and shoe itself eliminate the need for a wearer's own muscle mass to assist in such a deceleration. Additionally, this apparatus permits a wearer the same convenience as the foot orthosis ankle holster of carrying weaponry supplies and/or armor on the leg, instead of just traditional weapons. It should be noted that the benefits discussed here apply to exoskeleton 112 with bracket 216 as well as other simplified exoskeletons with direct-to-boot/shoe attachment brackets discussed below.

Referring now to FIGS. 3A and 3B, an ankle holster device with clip-on bracket 324 according to an embodiment of the present invention is shown. Clip-on bracket 324 is disposed at the bottom end of exoskeleton 112 and has a "boxy" J-like shape. Clip-on bracket 324 clips on the bottom of the sole of boot 218 just in front of the heel, wrapping under the sole. In some embodiments, the far end of clip-on bracket 324 is blunt, ending in an upward "J." In other embodiments, optional knob 326 extends horizontally from the upward end of the "J," and is employed to additionally secure clip-on bracket 324. For example, knob 326 can be made of a flexible rubber material that grips shoe/boot 218.

Referring now to FIGS. 3C and 3D, an ankle holster device with U-shaped heel bracket 328 according to an embodiment of the present invention is illustrated. U-shaped heel bracket 328 is disposed at the bottom end of exoskeleton 112 and has a U-shape for wrapping around a shoe/boot heel. Posterior U-shaped bracket 328, or clip, slips and grabs onto the heel of boot 218 at the point of attachment to the sole of the shoe. Generally, this area of the boot/shoe is less bulky than the above portions of the boot/shoe and is ideal for accommodating U-shaped bracket 328 so that it does not slip and can bear weight. A set screw is incorporated to help fixate the devise to the heel and accommodate width considerations.

Exoskeleton 112 provides another important feature, in addition to offloading weapon weight and resisting torque forces. Exoskeleton 112 acts as an inherent ankle support, protecting the ankle and preventing injuries. Consider, Special Forces operating in uneven terrain and extreme locations would benefit from the support and security of such a feature. A simple ankle sprain or strain occurring from falling or slipping will be minimized or perhaps prevented due to the rigid support to the medial/lateral column that the exoskeleton component of the holster provides. Such an injury could slow down or prevent a mission from moving ahead on its intended course, jeopardizing the safety of the participant, and even more the whole team. Additionally, injuries during military missions can compromise financial and time effort invested into such circumstances.

Referring now to FIGS. 4A, 4B, and 4C, a section of ankle holster exoskeleton, a magnified section of ankle holster exoskeleton, and a cross-section of ankle holster exoskeleton according to embodiments of the present invention are depicted, respectively. In a preferred embodiment, exoskeleton 112 comprises a set of hinged components 436 linked end to end. These hinged components are adjustable and can be manipulated to accommodate the unique contours of a wearer's lower leg. Once the components are in a desired position, set of screws 434 are tightened. In the preferred embodiment, over-laying component 430 and under-laying component 432 create a double, or two, hinge system for a wide range of adjustability. Connection of the components is enabled by flange 440 of under-laying component 432 slipping to a desired position under overlaying component 430, which has a longitudinal slot 435 in which screw 434 slides, and screw 434 being tightened to secure the connection. It should be understood that, while described here is a preferred embodiment of exoskeleton 112, other embodiments of exoskeleton 112 are envisioned and will be apparent to those trained in the art. For example, prefabricated or off-the-shelf exoskeletons in a set form may also be employed. Simplifications or additions to the hinged components will also be apparent. Therefore, the exoskeleton as described here is not to be considered as limiting.

Still referring to FIGS. 4A, 4B, and 4C, the preferred embodiment of the dual hinging system of exoskeleton 112 offers another feature. The hinge components are allowed to be adjusted on the frontal plane which allows exoskeleton 112 to accommodate height differences. This feature permits exoskeleton 112 to accommodate different wearers, adjusting to individual use. Therefore, this component of the ankle holster support can have many applications for government and military use as the exoskeleton is multi-user friendly and therefore an economical piece of equipment for agency use.

Several options are also available for the hinge components of exoskeleton 112. Hinged components 436 can be made with or without spring hinges, as is individually desired. Spring hinges offer a greater degree of assistance with walking with a holstered weapon than non-spring loaded hinges. "High-end users" in particular, such as members of the military, would benefit from this assistance in their daily, high stress usage. Ankle holster support systems supplied with a spring mechanism within the hinge(s) would use a wearer's forward acceleration/momentum to provide two vital aspects of assistance. The spring compresses to assist in deceleration during dorsiflexion of the foot following heel contact. Subsequently, the spring uses the stored energy of the compression to assist in the following propulsion phase as the foot rolls forward. The spring therefore allows muscles in the anterior and posterior of the ankle to not work as hard during deceleration and acceleration. These two important mechanisms help offset fatigue caused by hauling the additional weight of the weapon and holster. As technology permits, a motor component can also be inserted to the point of the hinge to assist in carrying even more of a load.

It should be noted that in the event exoskeleton 112 with hinged components 436 is applied directly in relation to the wearer's natural axis of motion and the axis is found exactly, resistance from the exoskeleton and ankle holster will be decreased. However, this is a difficult task in the best of situations. However, the general benefits of exoskeleton 112 remain, namely the two hinged system along with a central sliding slot mechanism at various levels and intervals to allow practically infinite adjustments according to the wearer's comfort. The major benefit will, therefore, be an easily adjustable hinged ankle and holster support. The dual hinged axis on the sagittal plane and frontal plane (referring also to FIGS. 1 and 2) will allow the wearer to set the angle at which the axis functions on the sagittal and frontal planes. This allows the wearer to best adapt the support device exoskeleton for the mechanics of the particular wearer's ankle/foot. While some biomechanical traits tend to be generic to most individuals, variations exist among people such as limited or hyper mobile joints of feet and ankles. Therefore, the hinged exoskeleton feature, in a preferred embodiment, allows total flexibility in application of the holster system to any sized individual.

Another benefit offered by exoskeleton 112 is assistance in the prevention of injury. The mechanism of action of the ankle is largely on one plane: sagittal, with the subtalar joint providing a tri-planar motion for the foot. The exoskeleton 112 allows for a portion of all of the normal motions of the ankle with its two hinged adjustable system, for a combination of flexibility and rigidness. However, exoskeleton 112 limits the extreme ends of an ankle's range of motion, thereby preventing injury of soft tissue or bone.

Figure 5:
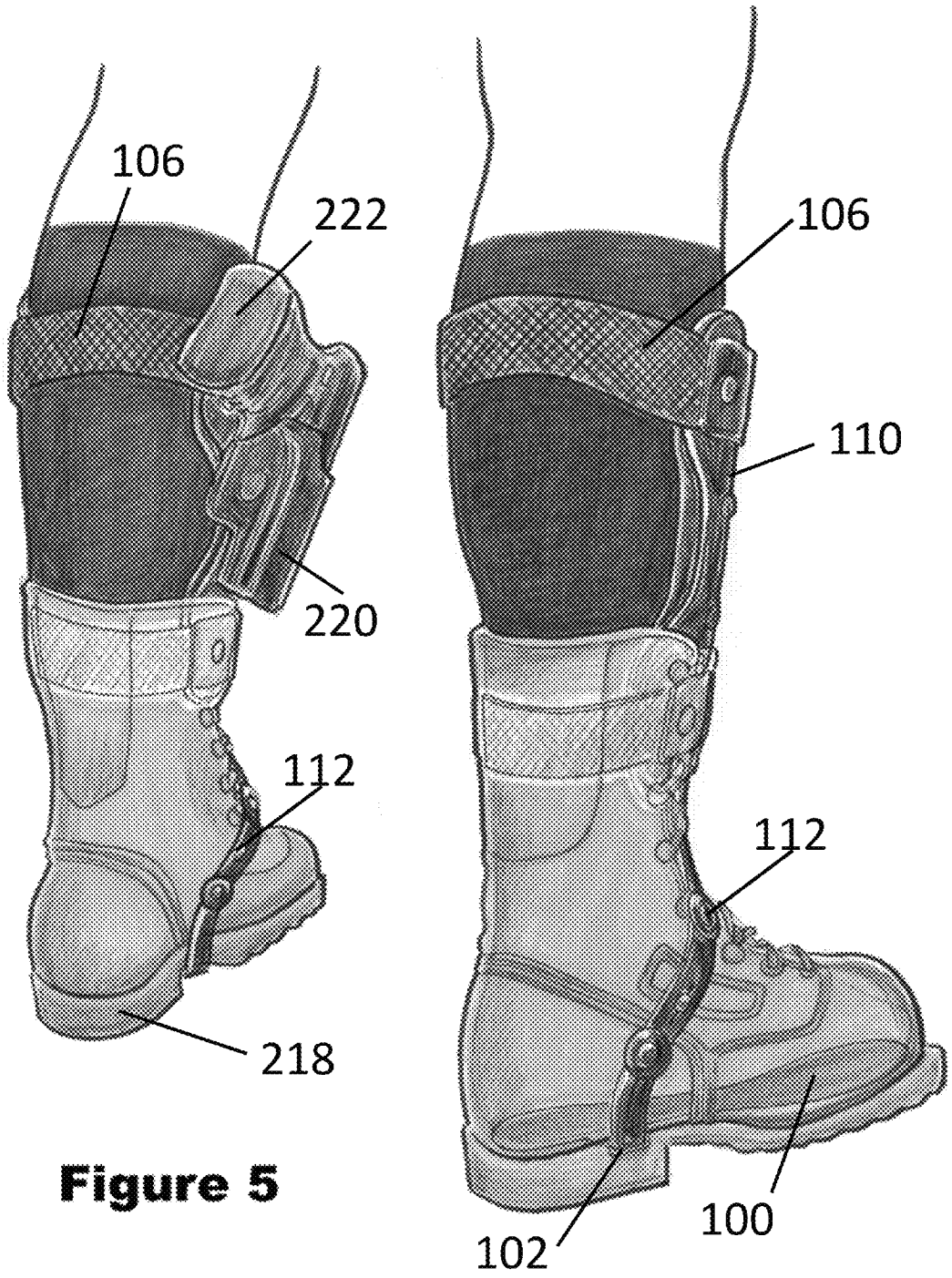
FIG. 5 depicts a dual utilization of ankle holster support devices according to an embodiment of the present invention.

Referring now to FIG. 5, a dual utilization of ankle holster support devices according to an embodiment of the present invention is shown. For several reasons, it may be desirable to equip both lower legs with ankle holsters. For example, if foot orthosis 100 is employed as part of the ankle holster as shown on the right leg in FIG. 5, a contralateral (custom) foot orthosis would be desirable for the other foot to balance out foot function. It would be a simple matter to add an exoskeleton to this contralateral foot orthosis. It may also be desirable to use a set of simplified exoskeleton 112 to shoe/boot 218 systems, as demonstrated on the left leg, where clip-on bracket 324 is employed. In either case, a second holster allows for the carrying of a second item on a second leg in addition to a first item carried on a first leg. For example, on the second leg a wearer could carry: a second pistol; a magazine for a weapon on the first leg; various alternative weapons such as a knife, taser, or stun gun; or supplies such as a flashlight, survival pack, ammunition, or armor. In fact, the versatility of the ankle holster support system is such that, for example, armor plating (e.g. ceramic) can be attached to various pouches attached to the holster support device, allowing protection of the lower extremity and items carried. This and other variations will be apparent to those trained in the art in light of this description of the present invention, which should not be considered limiting.

Although discussed primarily as a holster for a weapon or related items, the ankle holster of the present invention can also be employed to carry non-weapon or weapon-like items. For example, the ankle holster can be worn to carry an important item (e.g. a wallet) with the wearer when it is necessary to keep hands free. The ankle holster can even be used, for example, by members of a marching band to carry spare items (e.g., drum sticks) which may be needed later during a routine or march.

Figure 6:
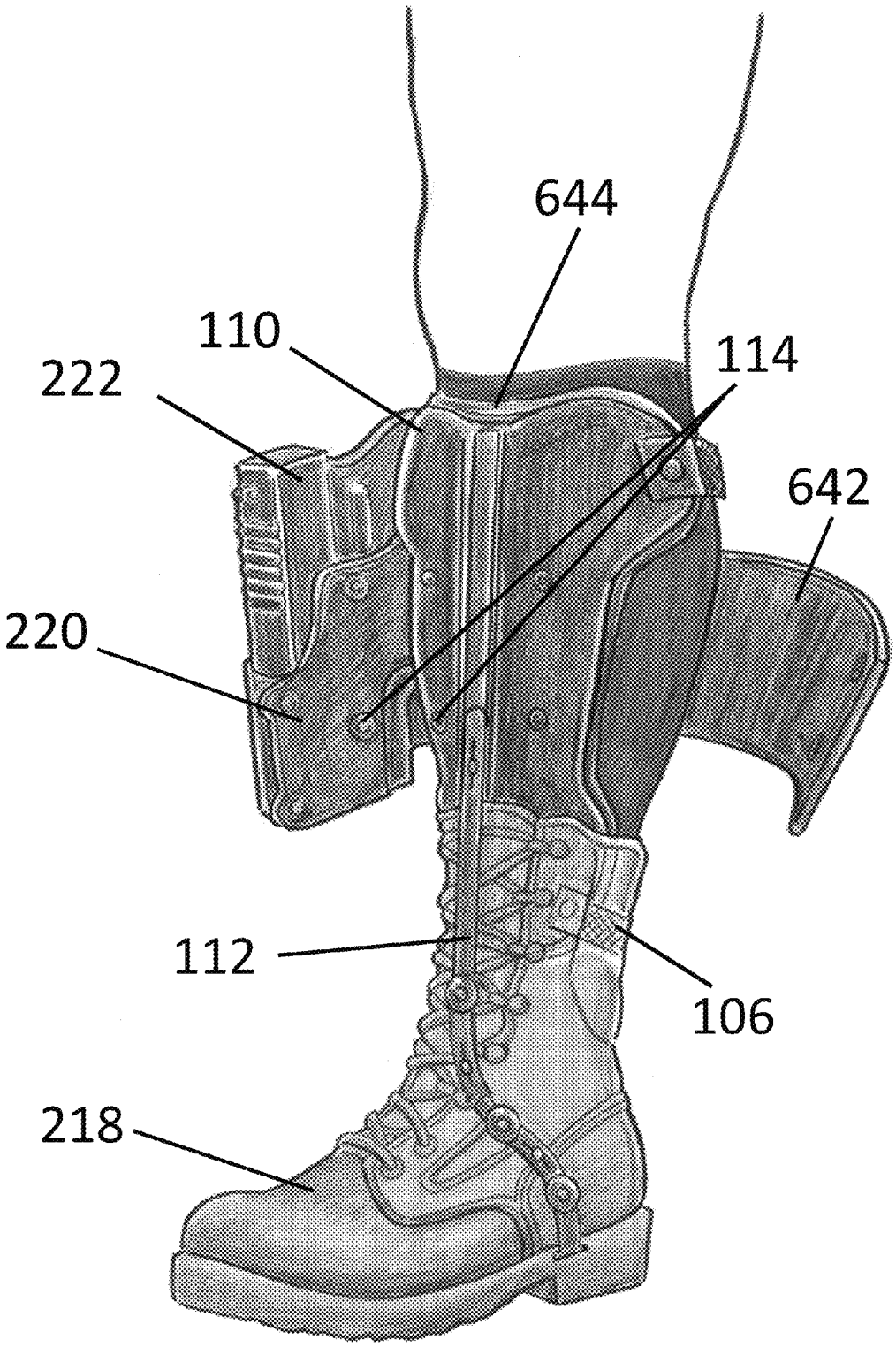
FIG. 6 depicts an ankle holster device with a padded anterior brace and snap-on holster according to an embodiment of the present invention.

Referring now to FIG. 6, an ankle holster device with a padded anterior brace 110 and snap-on holster 220 according to an embodiment of the present invention is illustrated. In addition to the offloading effects of exoskeleton 112 and foot orthosis 100 (FIG. 1), a brace near the top of exoskeleton 112 offers added relief from long-term wear of the ankle holster by providing additional points of contact. In a preferred embodiment (although other similar embodiments will be apparent) long anterior brace 110 with padding is incorporated to distribute pressure and weight over a large surface area of the anterior aspect of the tibia. Anterior brace 110 is furthermore adjustable and may be shifted as desired to produce maximum comfort (e.g., side to side, or superior to inferior). Padding/lining 644 on the inner face of brace 110 adds additional comfort and protection, and furthermore absorbs shear forces along contact points. In the preferred embodiment, a Spenco product, or similar product, will be used for the padding/lining (Spenco is a registered trademark of Spenco Medical Corporation.) Similar products include, but are not limited to: beds of silicone and silicone-like materials. It is preferable that padding/lining 644 be easy to clean and quick drying so as to work best under adverse conditions and minimize sore spots that could potentially be created at contact points between the brace and human skin under wet conditions.

Brace 110 may be held in place by a variety of apparatuses, including, but not limited to, a broad Velcro wrap 642 or individual straps 106. A wearer can customize the method or apparatus of attachment as desired. Straps 106 can be attached by several methods, including, but not limited to: snaps, ties, Velcro, hooks, buckles, pins and elastic.

Holster 220 is attached to brace 110 through one of several kinds of connectors 114. Connectors 114 include, but are not limited to: buckles, pins, snaps, ties, hooks, and Velcro. In this preferred embodiment, holster 220 can be taken on and off the ankle holster support device, allowing for a variety of weapons 222 and holsters 220 to be used with the holster support device. In one embodiment, holster 220 is made from the same material as exoskeleton 112 and part of the exoskeleton frame itself. However, this embodiment would limit the wearer to the particular weapon or item for which the holster was designed as opposed to offering the versatility of interchangeable holsters. A generic pouch-like holster and exoskeleton frame set may also be employed in some embodiments. Thus, the holster 220 comprises a hollow receptacle defined by a set of walls. The hollow receptacle is configured to receive therein at least a portion of a weapon or a supply.

The ankle holster of the present invention offers several advantages with respect to the issue of concealment. For various reasons, it is sometimes desirable to conceal the fact that one is armed. For example, police officers and federal agents working under cover, as well as certain civilians such as private investigators, may not want to reveal they are carrying a weapon. Features of the ankle holster, including thin Spenco product (or similar) padding/lining and an exoskeleton that can be as thin as one-fourth of an inch, help to minimize any chance of exposure. The main bulk of the device comes from the holster itself, which is effectively reduced in thickness along its medial extension, particularly because holster 220 (FIG. 6) lies against the thin brace (FIG. 6) and the wearer's skin. Furthermore, foot orthosis 100 (FIG. 1) and exoskeleton 112 (FIG. 1) correct a wearer's walk or gait, which would otherwise show signs of carrying the additional weight of a weapon on the leg. These measures effectively conceal a weapon carried by the ankle holster of the present invention.

Figure 7:
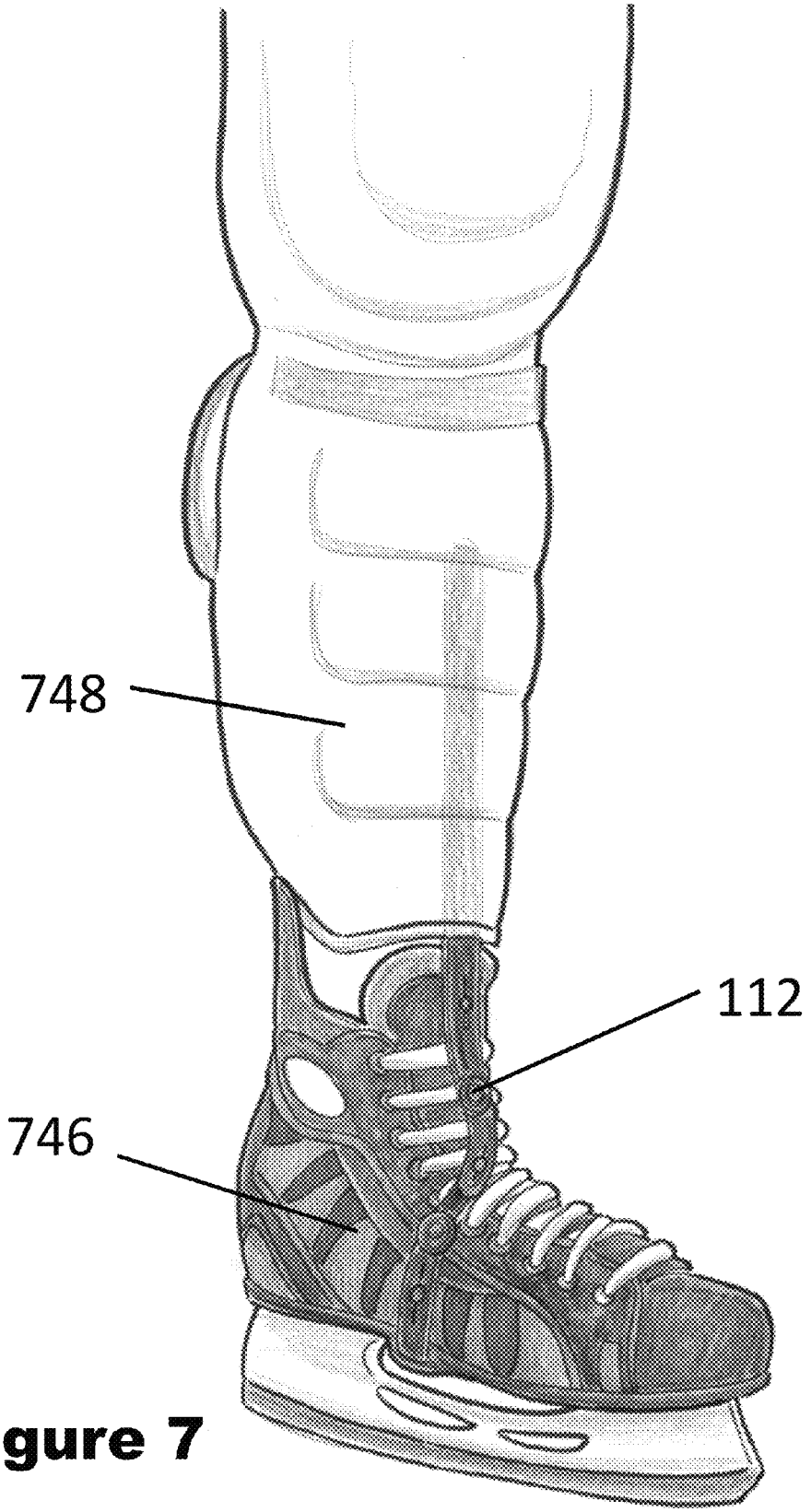
FIG. 7 depicts a shin protector according to an embodiment of the present invention.

Referring now to FIG. 7, a shin protector according to an embodiment of the present invention is depicted. In addition to supporting a weapon holster, exoskeleton 112 can also act as a shin protector for various athletic activities (e.g., hockey and soccer). For example, in hockey, exoskeleton 112 is inserted under traditional hockey padding 748 as an added measure of protection. Exoskeleton 112 offers protection against the direct forces of high impact strikes from a puck or hockey stick (not shown) by offsetting such blows over a large surface area. Exoskeleton 112 offers protection against injury, over-extension, and sprains not offered by traditional hockey padding 748 or hockey skate 746. As above, a wearer could choose to wear a foot orthosis with exoskeleton 112 or a simple boot/skate attachment bracket. Clearly, exoskeleton 112 can also be used as a shin protector, or shin guard, in other sports.

Figure 8:
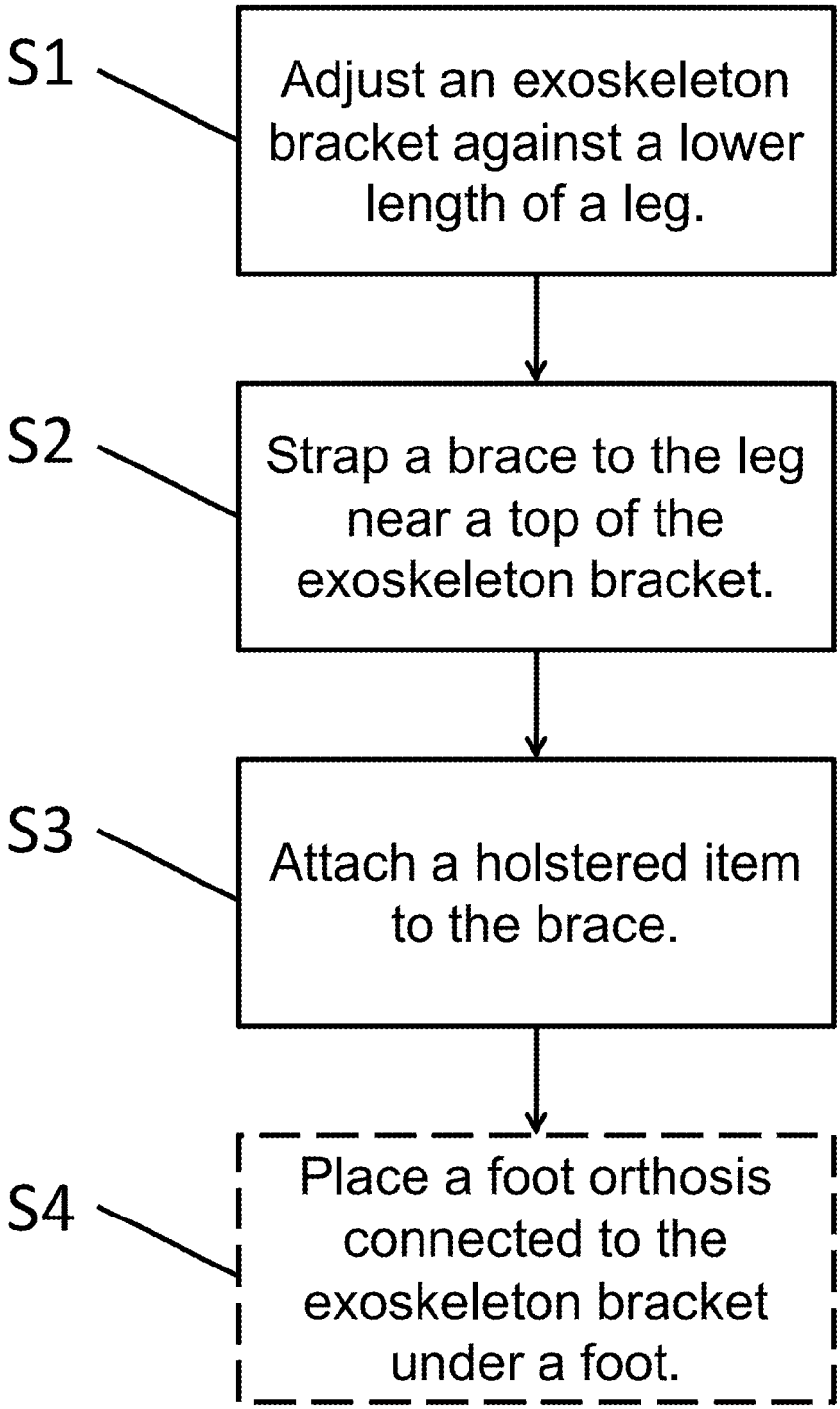
FIG. 8 depicts a method flow diagram for a method of carrying a holstered weapon according to an embodiment of the present invention.

Referring now to FIG. 8, a method flow diagram for a method of carrying a holstered weapon according to an embodiment of the present invention is shown. In step S1, an exoskeleton bracket is adjusted against a lower length of a leg. In step S2, a brace is strapped to the leg near the top of the exoskeleton bracket. In step S3, a holstered item is attached to the brace. In an optional step S4, a foot orthosis connected to the exoskeleton bracket is placed under a foot.

Figure 9:
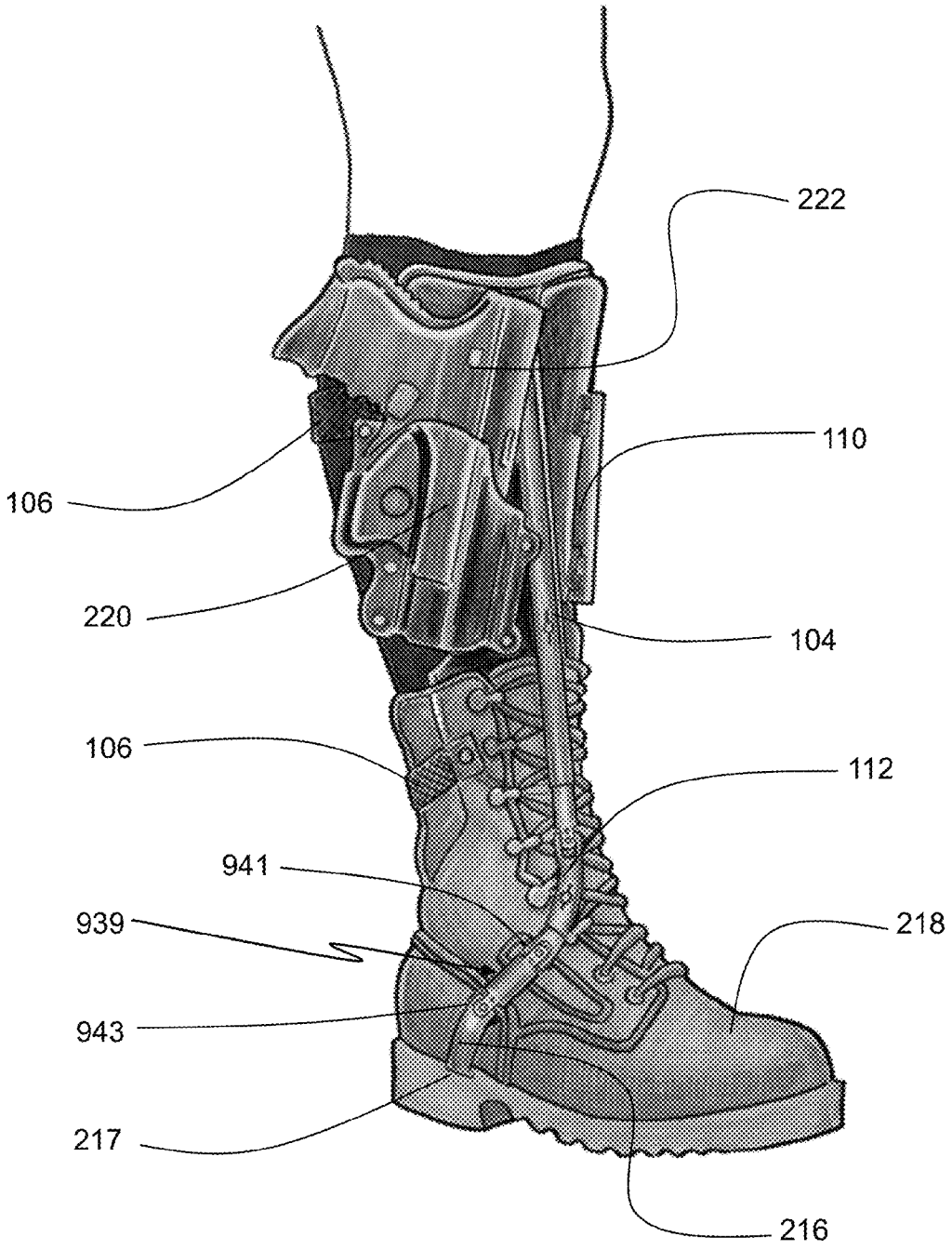
FIG. 9 depicts an ankle holster device with a variable resistance linkage according to an alternative embodiment of the present invention.

FIG. 9 depicts an ankle holster device with a variable resistance linkage according to an alternative embodiment of the present invention. In embodiments, the variable resistance linkage 939 is used in place of the hinged components described in FIGS. 4A-4C. The variable resistance linkage 939 provides an adjustable amount of resistance, such that when the wearer walks or runs, the device can provide resistance in one or more axis. The resistance can be tailored to a particular wearer based on physical condition and/or previous injuries. For example, a wearer may have an injury such that, as part of the recovery process, it is advisable to limit range of motion. Applying an appropriate amount of resistance can reduce the risk of over-extension, which could lead to a re-injury of the foot or leg. The variable resistance linkage may comprise one or more variable resistance joints. In the embodiment shown in FIG. 9, a first variable resistance joint 941 is connected to a second variable resistance joint 943. The variable resistance joints are mechanical couplings that allow the exoskeleton 112 to bend and twist along with the motion of the gait of the wearer.

Figure 10A:
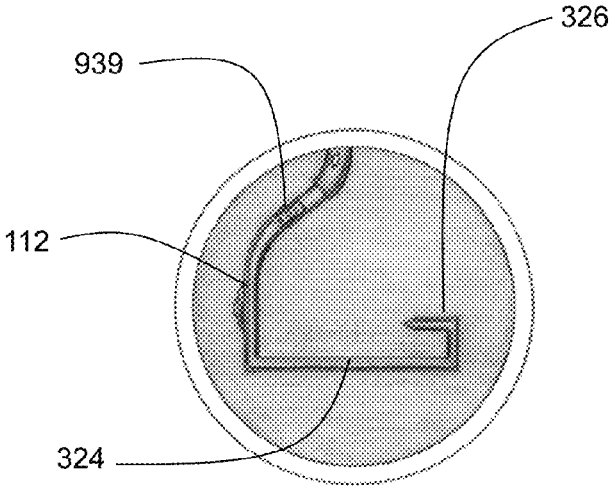
FIGS. 10A and 10B depict an ankle holster device with a variable resistance linkage utilizing a clip-on bracket according to an embodiment of the present invention.
Figure 10C:
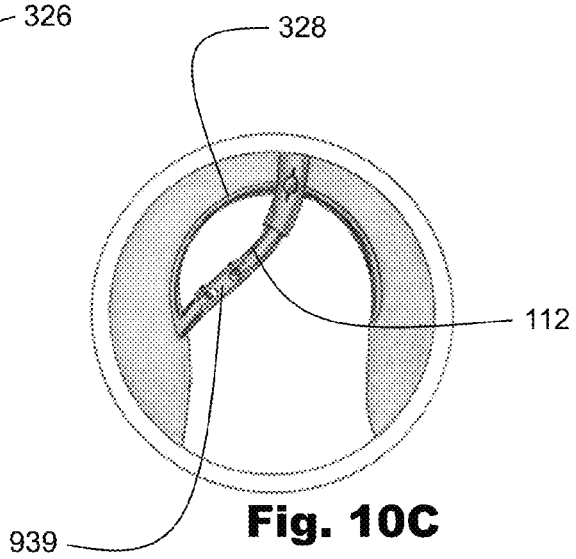
FIGS. 10C and 10D depict an ankle holster device with variable resistance linkage utilizing a U-shaped heel bracket according to an embodiment of the present invention.
Figure 10B:
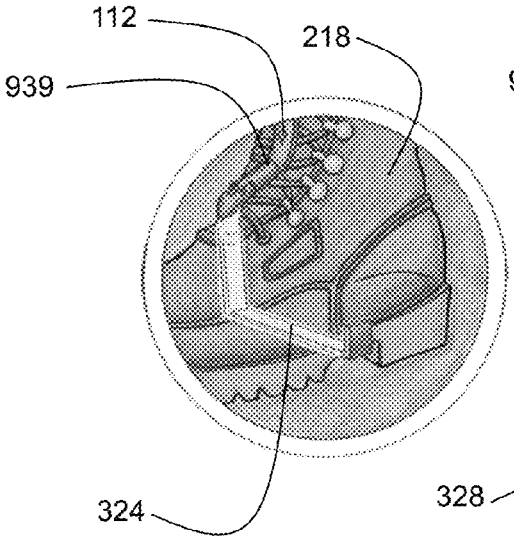

FIGS. 10A and 10B depict an ankle holster device with a variable resistance linkage 939 utilizing a clip-on bracket according to an embodiment of the present invention, which includes clip-on bracket 324. Clip-on bracket 324 is disposed at the bottom end of exoskeleton 112 and has a "boxy" J-like shape. Variable resistance linkage 939 is integrated into the exoskeleton 112. Clip-on bracket 324 clips on the bottom of the sole of boot 218 just in front of the heel, wrapping under the sole. In some embodiments, the far end of clip-on bracket 324 is blunt, ending in an upward "J." In other embodiments, optional knob 326 extends horizontally from the upward end of the "J," and is employed to additionally secure clip-on bracket 324. For example, knob 326 can be made of a flexible rubber material that grips shoe/boot 218.

Figure 10D:
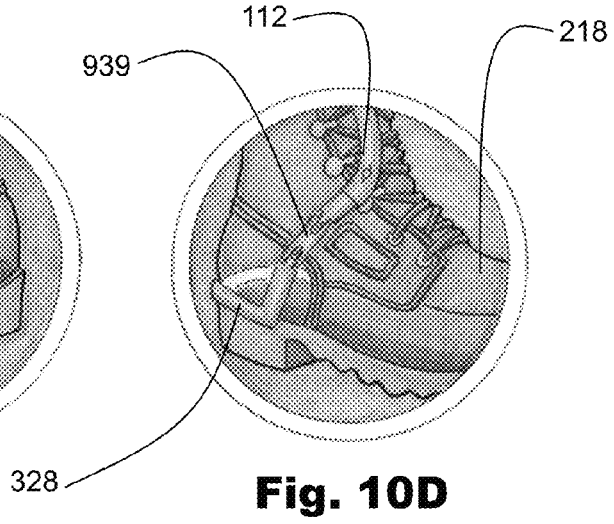

FIGS. 10C and 10D depict an ankle holster device with variable resistance linkage 939 utilizing a U-shaped heel bracket 328 according to an embodiment of the present invention. U-shaped heel bracket 328 is disposed at the bottom end of exoskeleton 112 and has a U-shape for wrapping around a shoe/boot heel. Variable resistance linkage 939 is integrated into the exoskeleton 112. Posterior U-shaped bracket 328, or clip, slips and grabs onto the heel of boot 218 at the point of attachment to the sole of the shoe. Generally, this area of the boot/shoe is less bulky than the above portions of the boot/shoe and is ideal for accommodating U-shaped bracket 328 so that it does not slip and can bear weight.

Figure 11A:
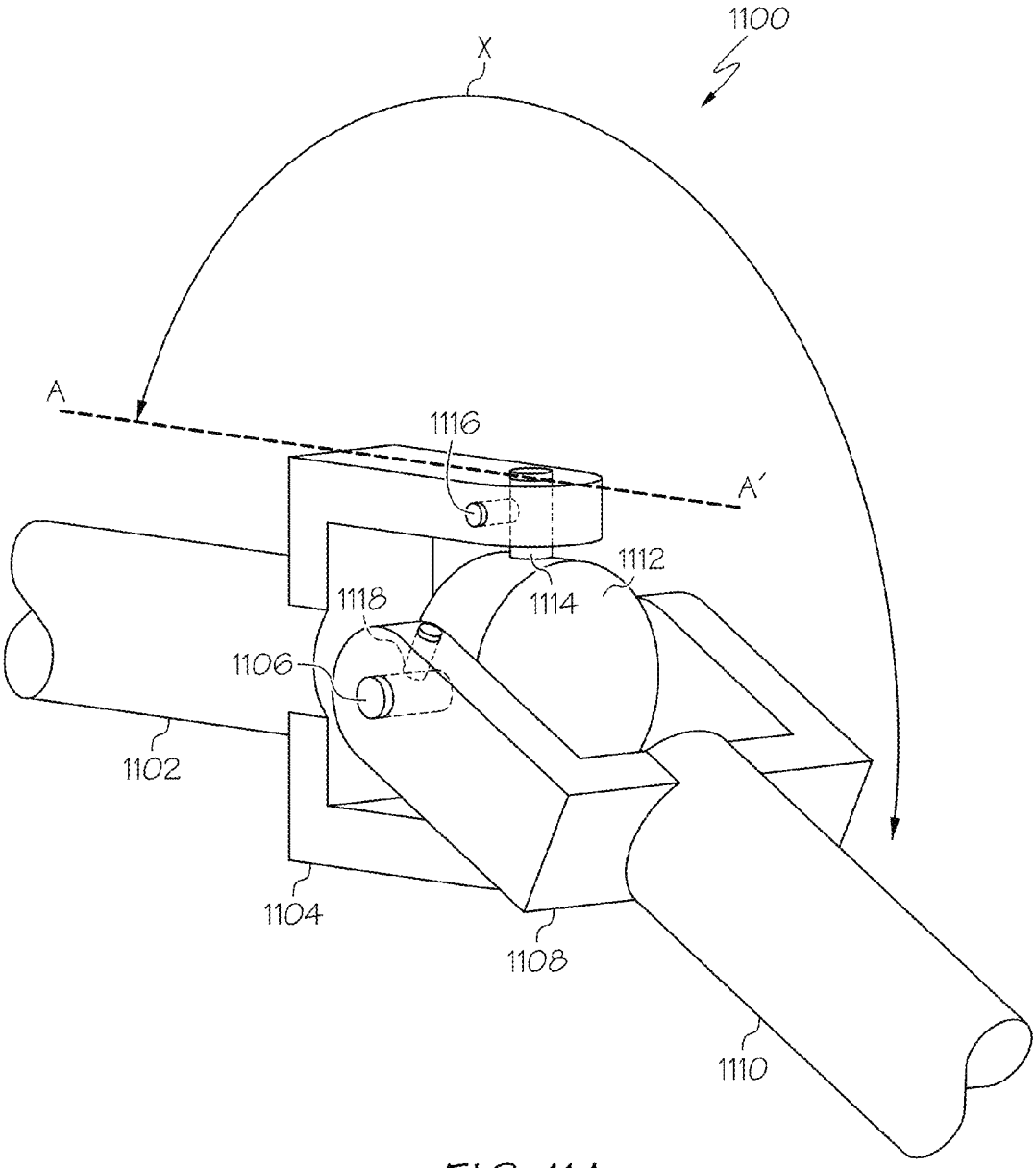
FIG. 11A is a perspective view of a variable resistance joint used in a variable resistance linkage in accordance with embodiments of the present invention.

FIG. 11A is a perspective view of a variable resistance joint 1100 used in a variable resistance linkage in accordance with embodiments of the present invention. The variable resistance joint 1100 is similar to resistance joint 941 and resistance joint 943 shown in FIG. 9. Thus, in embodiments, multiple resistance joints such as joint 1100 are connected in series as part of an exoskeleton. In embodiments, the variable resistance joints are positioned on the outer surface of the foot, near the ankle. The resistance joints are designed such that they allow motion in various directions to accommodate the gait of a wearer. However, the resistance of the joints are individually adjustable such that the amount of force required to flex the variable resistance joint 1100 can be increased. The motivation for increasing the resistance may include accommodating an injury of the wearer. With certain types of injuries, it is desirable to increase resistance to discourage a wide range motion in a particular direction. The variable resistance joint 1100 comprises a first elongated member 1102. The first elongated member 1102 has a fork 1104 disposed on an end. The variable resistance joint 1100 further comprises a second elongated member 1110, which similarly, has a fork 1108 disposed on an end. A central hub 1112 is rotatably secured to fork 1104 and the fork 1108 by a plurality of axles (1106 and 1114). The axles are affixed to the central hub 1112. Multiple resistance members 1116 and 1118 are configured to apply an adjustable amount of resistance to the axles, 1114 and 1106, respectively. Thus, the variable resistance joint 1100 allows the first elongated member 1102 and the second elongated member 1110 to be displaced at a variable angle X. This allows for flexibility in the exoskeleton to accommodate the stride and gait of a wearer. The resistance members 1116 and 1118 may be threaded shafts that can be adjusted (e.g., by a screwdriver or wrench) to apply a desired amount of mechanical resistance to their corresponding axle. Threaded holes in the forks 1104 and 1108 receive the resistance members 1116 and 1118, respectively. By tightening the resistance members 1116 and 1118, the resistance members contact a circumferential surface of their corresponding axle to provide mechanical resistance, and the resistance members enable increased motion resistance between a fork and its corresponding axle.

Figure 11B:
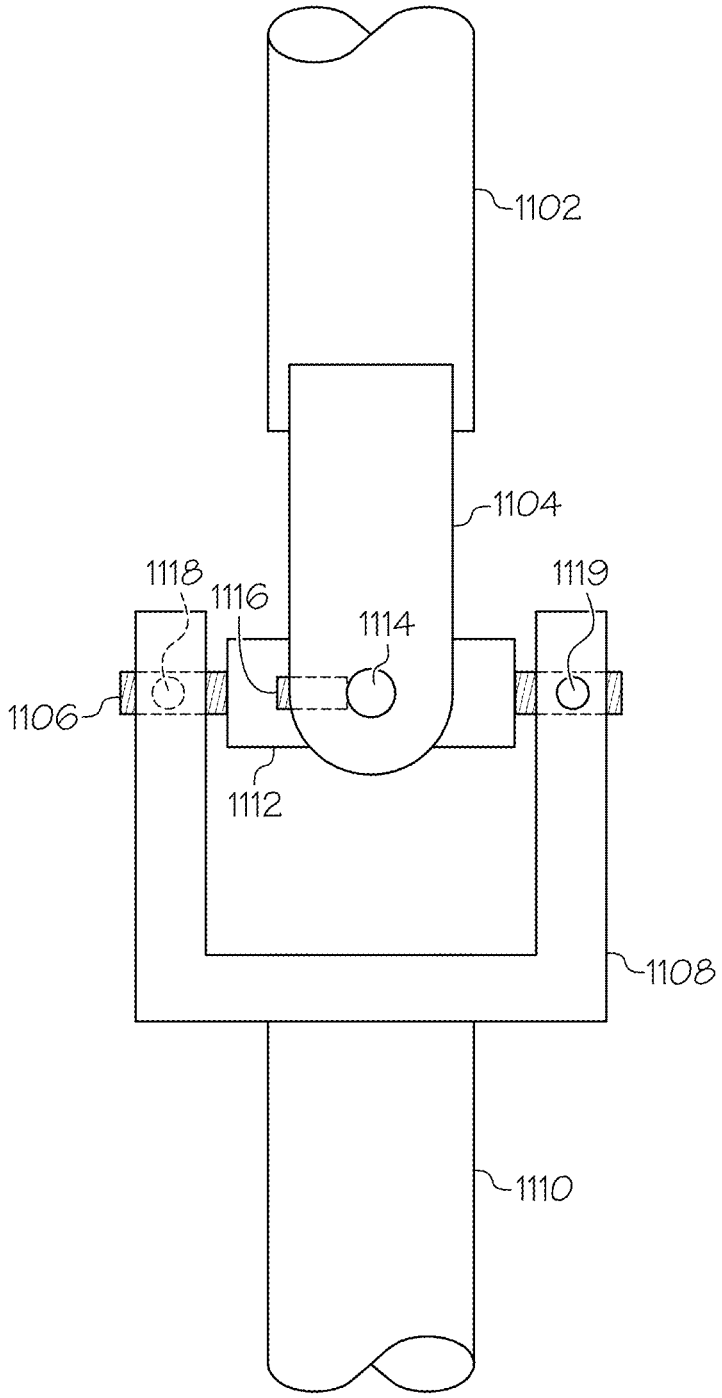
FIG. 11B is a view of a variable resistance joint as viewed along line A-A' of FIG. 11A.

The axles of resistance members 1116 and 1118 are rotatably affixed to the forks 1104 and 1108 by a circular opening within the forks. The axles are stationary with respect to the fork, such that the resistance members 1116 and 1118 can be configured to apply resistance to the axles, thereby requiring more effort to move the first elongated member 1102 with respect to second elongated member 1110. Thus, the amount of difficulty required by the wearer to change the angle X between the first elongated members 1102 and second elongated member 1110 can be adjusted on an individual basis. FIG. 11B is a view of a variable resistance joint as viewed along line A-A' of FIG. 11A, indicating that each fork may comprise multiple resistance members. Thus, in the view of FIG. 11B, fork 1108 is shown to have a resistance member 1118 on one side, and a similar resistance member 1119 on an opposite side.

Figure 12:
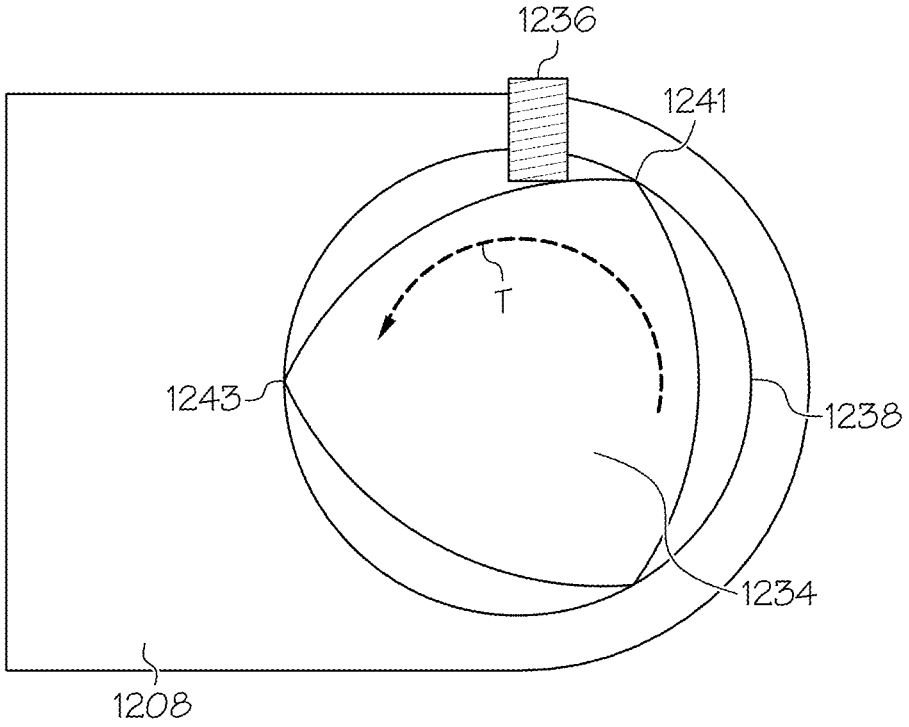
FIG. 12 is a detailed view of a travel limiting mechanism in accordance with alternative embodiments of the present invention.

FIG. 12 is a detailed view of a travel limiting mechanism (motion-limiting mechanism) in accordance with alternative embodiments of the present invention. A cam 1234 is rotatably secured to an axle, and fits within the circular opening 1238 of fork 1208. Fork 1208 may be similar to fork 1108 shown in FIGS. 11A and 11B. The cam 1234 is of a non-circular shape, and may be triangular, oblong, wedge-shaped, or other suitable shape. As the cam, which is attached to an axle, rotates in direction T, a first apex 1241 of cam 1234 contacts threaded shaft 1236, which is configured and disposed to protrude into the circular opening 1238, such that it limits rotational travel of the cam 1234, thereby limiting the range of motion of the variable resistance joint (the limits of angle X in FIG. 11A). Similarly, in a direction opposite to T, second apex 1243 limits direction of travel. Thus, the position of first apex 1241 and second apex 1243 determine the range of motion of the linkage. In practice, the linkages may be manufactured with a variety of different cams, in order to customize the range-of-motion limits for a particular wearer. For example, a person recovering from a previous injury may need to restrict the range of motion. Once the injury is fully healed, the threaded shaft 1236 can be adjusted such that it no longer protrudes into circular opening 1238, thereby removing the range limitations.

Figure 13:
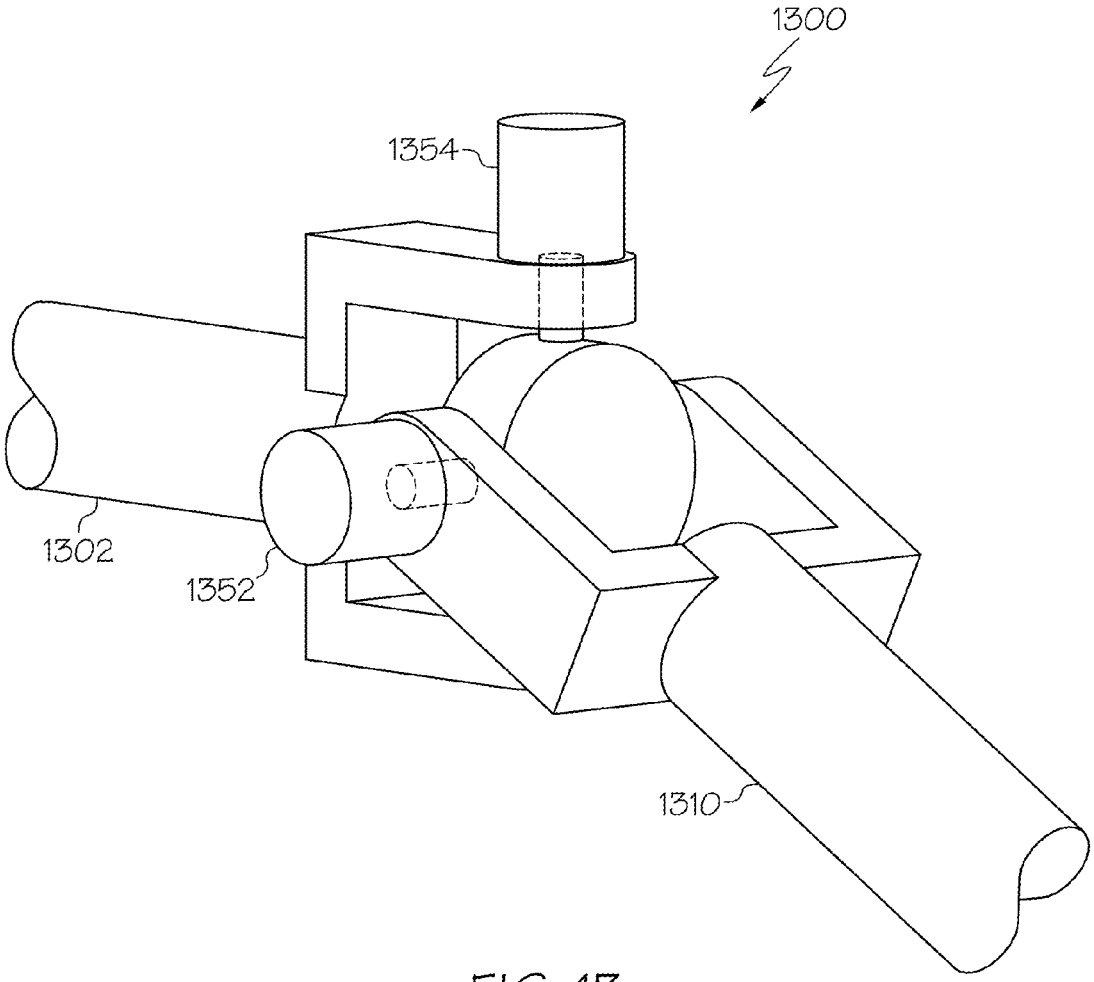
FIG. 13 is a perspective view of an electrically-controlled variable resistance joint used in variable resistance linkage in accordance with alternative embodiments of the present invention.

FIG. 13 is a perspective view of an electrically-controlled variable resistance joint 1300 used in a variable resistance linkage in accordance with alternative embodiments of the present invention. Joint 1300 is similar to joint 1100 of FIG. 11A, (e.g. it has elongated member 1302 similar to member 1102 of FIG. 11A, and elongated member 1310 similar to member 1110 of FIG. 11A, etc.), except that instead of the resistance members 1116 and 1118, servomotors 1352 and 1354 are used to provide resistance and/or range-of-motion limits. The servomotors 1352 and 1354 are electrically powered, and may be powered from a battery pack (not shown) worn by the wearer elsewhere on his body (e.g. in a backpack, for example). The servomotors may also have positional encoders therein to enable range-of-motion limitations. For example, once a particular angular position is detected by the servomotor (e.g. an angle X in FIG. 11A), then the corresponding servomotor is energized to provide resistance and/or range limiting motion. Thus, for example, when an ankle is flexed such that a particular angle (e.g. A in FIG. 11A) is exceeded, then the corresponding servomotor that controls that angle (e.g. 1352 of FIG. 13) may activate to prevent further movement, or may provide a certain amount of resistance to discourage additional movement in a particular direction. In some embodiments, when a wearer extents his leg on which the bracket is attached, the servomotors provide a desirable limited flexibility in the bracket by each providing a limited range in which the forks of the resistance joint can move with respect to each other. In some embodiments, the servomotors may actively move their respective forks as the wearer moves. In embodiments, the servomotors 1352 and 1354 may be controlled by an on-board microprocessor to implement the resistance and range-of-motion settings.

Figure 14:
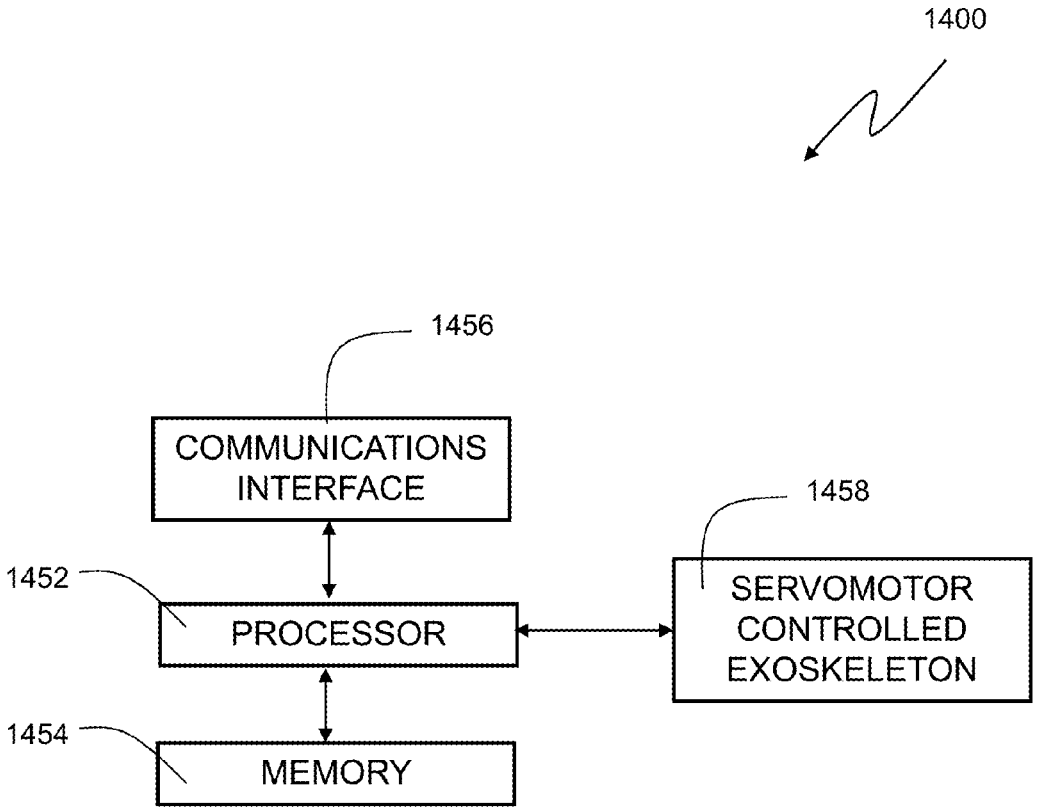
FIG. 14 is a block diagram of a system utilizing an electrically-controlled variable resistance joint.

FIG. 14 is a block diagram of a system 1400 utilizing an electrically-controlled variable resistance joint, such as joint 1300 shown in FIG. 13. A processor 1452 is coupled to memory 1454. Memory 1454 contains instructions, which when executed by processor 1452, control servomotor controlled exoskeleton 1458. Exoskeleton 1458 comprises one or more electrically-controlled variable resistance joints 1300 (FIG. 13). The processor controls the activation of servomotors within the exoskeleton 1458, and may also retrieve positional information from the servomotors within the exoskeleton 1458. Optionally, a communications interface 1456 may be included as part of the system, such that the variable resistance and/or range-limiting parameters can be updated in the field. In embodiments, communications interface 1456 is a wireless communications interface such as a cellular interface, and may include a radio, modulator/demodulator, error correction, and other components in order to receive and/or transmit data and/or control information. The communications interface 1456 can be used to receive a resistance configuration from a remote location. The resistance configuration contains parameters that determine the amount of resistance and/or range-of-motion limits to be applied by the servomotors. In other embodiments, the parameters may be programmed prior to being donned by the wearer. In such embodiments, the parameters may be programmed via a wired connection such as a serial port or USB port (not shown), and in such embodiments, the wireless communication interface may not be present.

Thus, in an example usage, if a soldier wearing such a device is injured in the field (such as with an ankle sprain), medical personnel can remotely configure the exoskeleton to apply additional resistance and/or range-of-motion limitations to help prevent further injury until the soldier can return to a base/camp for additional treatment. The processor, memory, communications interface, and power source (not shown), may be part of the device, and may be affixed directly to the exoskeleton, or may be worn on a different part of the body (such as a backpack or rucksack) and wires connecting to the exoskeleton may provide power and control signals to the exoskeleton.

In addition to the above-mentioned examples, various other modifications and alterations of embodiments of the present invention are possible. While embodiments of the present invention has been particularly shown and described in conjunction with preferred embodiments thereof, it will be appreciated that variations and modifications will occur to those skilled in the art. Accordingly, the above disclosure is not to be considered as limiting, and the appended claims are to be interpreted as encompassing the true spirit and the entire scope of the invention.

What is claimed is:

1. A device, comprising:

a foot orthosis comprising a first edge and a second edge such that, when the device is donned by a wearer, the first edge is oriented along an outside edge of a foot of the wearer and the second edge is oriented along an inside edge of the foot of the wearer;

a brace configured such that when the device is donned by a wearer, a position of a vertical center axis of the brace substantially aligns with a position of a vertical center axis of a shin of the wearer;

an essentially vertical anterior exoskeleton comprising an elongated member disposed along the vertical center axis of the brace and extending from the brace to the first edge of the foot orthosis; and a variable resistance linkage disposed along the exoskeleton, the variable resistance linkage configured such that, when the device is donned by the wearer, at least a portion of the exoskeleton is allowed to move with the foot of the wearer at least in a frontal plane and a sagittal plane.

2. The device of claim 1, wherein the variable resistance linkage comprises a variable resistance joint.

3. The device of claim 2, wherein the variable resistance joint comprises:

a first elongated member;

a first fork disposed on a distal end of the first elongated member;

a second elongated member;

a second fork disposed on a distal end of the second elongated member;

a central hub rotatably secured to the first fork and the second fork by a plurality of axles; and a plurality of resistance members configured to apply an adjustable amount of resistance to the plurality of axles.

4. The device of claim 3, wherein the plurality of resistance members each comprise a threaded shaft configured and disposed to contact a circumferential surface of one of the plurality of axles.

5. The device of claim 3, further comprising a motion-limiting mechanism.

6. The device of claim 5, wherein the motion-limiting mechanism comprises:

a cam affixed to one of the plurality of axles, wherein the cam is disposed within a circular opening in the first fork;

a threaded shaft configured and disposed to protrude into the circular opening, such that the threaded shaft limits rotational travel of the cam.

7. The device of claim 3, wherein the plurality of resistance members each comprise a servomotor.

8. The device of claim 7, further comprising:

a processor;

a memory coupled to the processor;

wherein the memory contains instructions, that when executed by the processor, apply variable resistance and range-of-motions parameters to each servomotor.

9. The device of claim 8, further comprising a communications interface configured and disposed to receive a resistance configuration from a remote location.

10. The device of claim 1, the brace having a holster for one of: a gun, an alternative weapon, and a supply, attached.

11. A device, comprising:

a holster support comprising: an exoskeleton, a brace connected at essentially a top end of the exoskeleton, an item of footwear attaching to a bottom end of the exoskeleton, and a variable resistance linkage disposed along the exoskeleton, the variable resistance linkage comprising two variable resistance joints; and a holster connected to the brace of the holster support;

wherein the item of footwear comprises a first edge and a second edge such that, when the device is donned by a wearer, the first edge is oriented along an outside edge of a foot of the wearer and the second edge is oriented along an inside edge of the foot of the wearer;

wherein the brace is configured such that when the device is donned by a wearer, a position of a vertical center axis of the brace substantially aligns with a position of a vertical center axis of a shin of the wearer;

wherein the variable resistance linkage is configured such that, when the device is donned by the wearer, at least a portion of the exoskeleton is allowed to move with the foot of the wearer at least in a frontal plane and a sagittal plane; and wherein the exoskeleton comprises an elongated member disposed essentially along the vertical center axis of the brace and extending from the brace to the first edge of the item of footwear.

12. The device of claim 11, wherein each variable resistance joint comprises:

a first elongated member;

a first fork disposed on a distal end of the first elongated member;

a second elongated member;

a second fork disposed on a distal end of the second elongated member;

a central hub rotatably secured to the first fork and the second fork by a plurality of axles; and a plurality of resistance members configured to apply an adjustable amount of resistance to the plurality of axles.

13. The device of claim 12, wherein the plurality of resistance members each comprise a threaded shaft configured and disposed to contact a circumferential surface of one of the plurality of axles.

14. The device of claim 12, further comprising a motion-limiting mechanism.

15. The device of claim 14, wherein the motion-limiting mechanism comprises:

a cam affixed to one of the plurality of axles, wherein the cam is disposed within a circular opening in the first fork;

a threaded shaft configured and disposed to protrude into the circular opening, such that it limits rotational travel of the cam.

16. The device of claim 12, wherein the plurality of resistance members each comprise a servomotor.

17. The device of claim 11, the item of footwear being at least one of: a boot and a shoe, and the item of footwear attaching to the exoskeleton by one of: an L-bracket slipped into a slot, a U-bracket wrapped around a heel, and a clip-on bracket wrapped under a sole.

18. A device comprising:

an exoskeleton, a brace connected at essentially a top end of the exoskeleton, an item of footwear attaching to a bottom end of the exoskeleton, and a variable resistance linkage disposed along the exoskeleton, the variable resistance linkage comprising:

a first variable resistance joint;

a second variable resistance joint;

a first elongated member mechanically coupled to the first variable resistance joint;

a first fork disposed on a distal end of the first elongated member;

a second elongated member mechanically coupled to the second variable resistance joint;

a second fork disposed on a distal end of the second elongated member;

a central hub rotatably secured to the first fork and the second fork by a plurality of axles;

a third elongated member mechanically coupled to the first variable resistance joint and also mechanically coupled to the second variable resistance joint; and a plurality of resistance members configured to apply an adjustable amount of resistance to the plurality of axles.

19. The device of claim 18, wherein the first variable resistance joint and the second variable resistance joint each comprise a threaded shaft configured and disposed to contact a circumferential surface of one of the plurality of axles.

20. The device of claim 19, further comprising a motion-limiting mechanism, wherein the motion-limiting mechanism comprises:

a cam affixed to one of the plurality of axles, wherein the cam is disposed within a circular opening in the first fork;

a threaded shaft configured and disposed to protrude into the circular opening, such that it limits rotational travel of the cam.

* * * * *